United States Patent [19]

Hammar

[11] 4,207,445

[45] Jun. 10, 1980

[54] ON-LOAD TAP CHANGER SWITCH ASSEMBLY

[75] Inventor: Karl E. Hammar, Ludvika, Sweden

[73] Assignee: ASEA Aktiebolag, Vesteras, Sweden

[21] Appl. No.: 845,290

[22] Filed: Oct. 25, 1977

[30] Foreign Application Priority Data

Oct. 29, 1976 [SE] Sweden ..... 7612026

[51] Int. Cl.[2] ..... H01H 21/20

[52] U.S. Cl. ..... 200/11 TC; 200/153 PA

[58] Field of Search ..... 200/11 TC, 153 L, 153 P, 200/153 PA

[56] References Cited

U.S. PATENT DOCUMENTS

| | | | |
|---|---|---|---|
| 2,200,990 | 5/1940 | Lennox et al. | 200/11 TC X |
| 3,176,089 | 3/1965 | Bliebtreu et al. | 200/11 TC X |
| 3,250,864 | 5/1966 | Bliebtreu et al. | 200/11 TC |
| 3,643,154 | 2/1972 | Van Riemsdijk | 200/11 TC X |
| 3,798,395 | 3/1974 | Norman et al. | 200/11 TC X |
| 3,902,030 | 8/1975 | Popa | 200/11 TC |

*Primary Examiner*—James R. Scott

*Attorney, Agent, or Firm*—Watson, Cole, Grindle & Watson

[57] ABSTRACT

In an on-load tap changer comprising a step selector operated by two shafts which are rotatable with respect to each other, a damping switch for temporarily switching in a damping resistor during a plus/minus or a coarse/fine switching operation is operated by a cam member fixedly mounted on one of the two shafts.

3 Claims, 7 Drawing Figures

ON-LOAD TAP CHANGER SWITCH ASSEMBLY

BACKGROUND OF THE INVENTION

1. Field of the Invention

The present invention relates to an on-load tap changer of the kind having a diverter switch, a step selector, a plus/minus or coarse/fine switch and a switch for temporarily switching in a damping resistor during a plus/minus or a coarse/fine switching operation.

PRIOR ART

In transformers with plus/minus and coarse/fine regulation, respectively, the fine step regulating winding is usually made in the form of a separate winding part connected to the other windings, such as a base winding and, where applicable a coarse step winding, by means of a so-called plus/minus and coarse/fine switch, respectively. When such a switch is operated, the regulating winding becomes "floating" during the switching interval, if no particular measures are taken, and thereby adopts a voltage which is determined by its capacitance with respect to ground and to the other windings. The capacitive charging current causes arcs at the switch contacts, which results in contact erosion, gas formation and fouling of the transformer oil. Additionally, there is a risk of direct short-circuiting over the regulating winding if the switch is not capable of breaking the capacitive currents at high voltages which occur in high-voltage transformers.

To solve the above-mentioned problem, it is known to use high-ohmic damping resistors, which during the above-mentioned switching interval, by means of a special contact system, for example in the form of a one or three-pole switch, are connected between some point on the regulating winding and the base winding or the neutral point of the transformer.

In a previously known construction of the kind mentioned in German Patent Specification No. 1,942,567, the damping resistor switch is operated from the drive means of the plus/minus switch through a separate drive shaft and a Geneva gear. However, such an embodiment is very bulky and costly.

SUMMARY OF THE INVENTION

The purpose of the present invention is to achieve a more simple driving of the damping resistor switch in an on-load tap changer of the above-mentioned kind. Additionally, the embodiment of the invention provides a good overlap between the switching intervals of the damping resistor switch and the plus/minus or coarse/fine switch, respectively.

BRIEF DESCRIPTION OF THE INVENTION

The invention will be described in more detail with reference to an embodiment shown in the accompanying drawings wherein.

DETAILED DESCRIPTION

Figure 1:
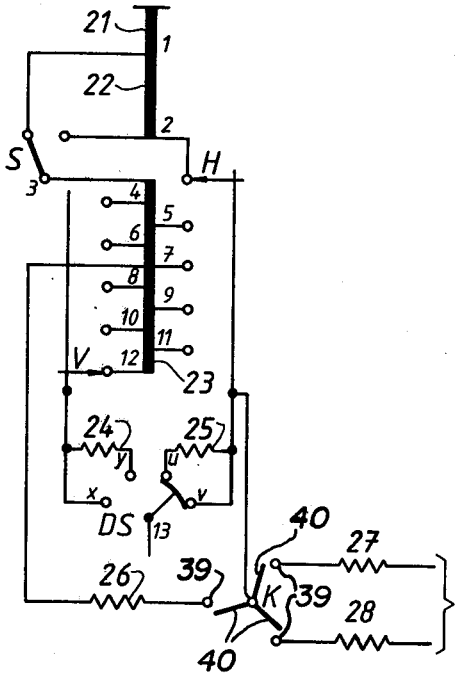
FIG. 1 shows the connection for an on-load tap changer connected to a transformer, of the kind to which the invention relates.

FIG. 1 shows one phase of a Y-connected, three-phase transformer provided with an on-load tap changer for coarse/fine regulation. The transformer consists of basic winding 21, coarse step winding 22 and fine step winding 23. One or the other of terminals 1 and 2 of the coarse step winding may be connected to terminal 3 of the fine step winding by coarse/fine switch S. Fine step winding 23 is provided with nine additional tappings 4–12, which together with terminal 2 on coarse step winding 22 are each connected to a fixed contact on step selector TS which has two movable selector arms V and H. Selector arm V coacts with the contacts connected to tappings 4, 6, 8, 10 and 12, whereas selector arm H coacts with the contacts connected to tappings 2, 5, 7, 9 and 11. Selector arms V and H are each connected to a fixed contact x and v, respectively, of diverter switch DS by sliding contact devices. Diverter switch DS is provided with bridging resistors 24 and 25 connected to the intermediate contacts y and u of the diverter switch. Movable contact 13 of the diverter switch is connected to the neutral point of the transformer.

Tapping 7 of fine step winding 23 may be connected to the fixed contact v of diverter switch DS by damping resistor 26 and damping switch K. Also, tappings 7 on the other transformer phases are connected to switch K, which is three-polar, by damping resistors 27 and 28.

Figure 2:
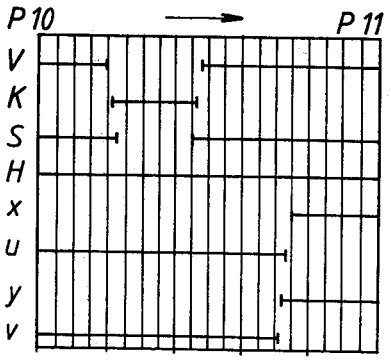
FIG. 2 illustrates the switching sequence for the on-load tap changer upon switching between two transformer tappings in the middle of the regulating range.

With the connection as shown, nineteen positions of the on-load tap changer are obtained, of which the tenth position is shown in FIG. 1. FIG. 2 illustrates the switching sequence when switching from the tenth to the eleventh position, the unbroken line showing the closed contact position. Switching is performed as follows:

Selector contact V opens from tapping 12, and switch K closes and switches in damping resistor 26. Thereafter coarse/fine switch S is switched from tapping 1 to tapping 2, whereafter switch K is again opened and selector contact V closes on tapping 4. Diverter switch DS then completes the switching by transferring the load current from contact v to contact x through resistor contacts u and y. It is important that switch K closes before and opens after the time interval when switch S is opened. However, the closing interval of switch K need not necessarily be shorter than the opening interval of selector contact V, as shown in FIG. 2.

Figure 3:
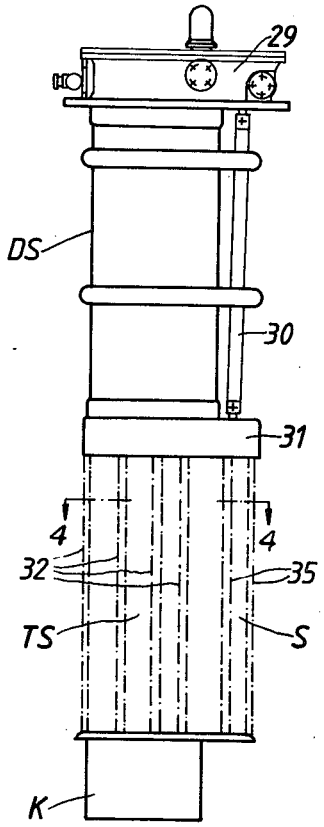
FIGS. 3 and 4 show schematically an embodiment of the on-load tap changer, FIG. 3 being a side view and FIG. 4 a section along the line 4—4 of FIG. 3.
Figure 4:
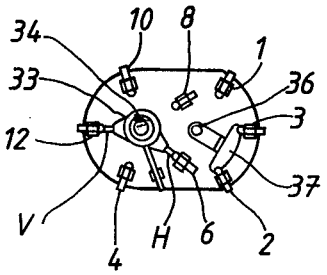

FIGS. 3 and 4 show schematically how an on-load tap changer according to the invention may be constructed. It consists of diverter switch DS oil-tightly enclosed in an insulating cylinder, step selector TS with coarse/fine switch S and switch K for the damping resistor. The on-load tap changer is intended to be mounted suspended from the transformer lid. It is operated by a motor device (not shown), the movement being transmitted from upper part 29 of the diverter switch housing through vertical shaft 30 to gear 31 for diverter switch DS and selector TS. Certain auxiliary equipment, such as a pressure switch, a position indicator, etc., are mounted on upper part 29.

Selector TS consists of insulating rods 32, arranged in a circle, with fixed contacts mounted thereon. At the center, there are two concentrically placed drive shafts 33 and 34 which are each driven by a Geneva wheel in gear 31. Each drive shaft supports one selector arm per phase. Selector arms V of the outer shaft are clamped on shaft 33, whereas contact arms H of the inner shaft are journalled on the outer shaft and fixedly connected to inner shaft 34 by a pin which passes through a free-wheel slot in outer shaft 33. The contact arms move in planes located above one another and each arm cooperates with a set of fixed contacts. The contact arms are connected to diverter switch DS by slip rings and current collector contacts (not shown).

Coarse/fine switch S has three fixed contacts 1, 2, 3 per phase, which are each positioned on an insulating rod 35. Changing-over is achieved with contact bridge 37 which is rotatable about shaft 36. Shaft 36 is set in motion by a fork arm from a drive pin on one of the Geneva wheels of the selector shafts.

Figure 5:
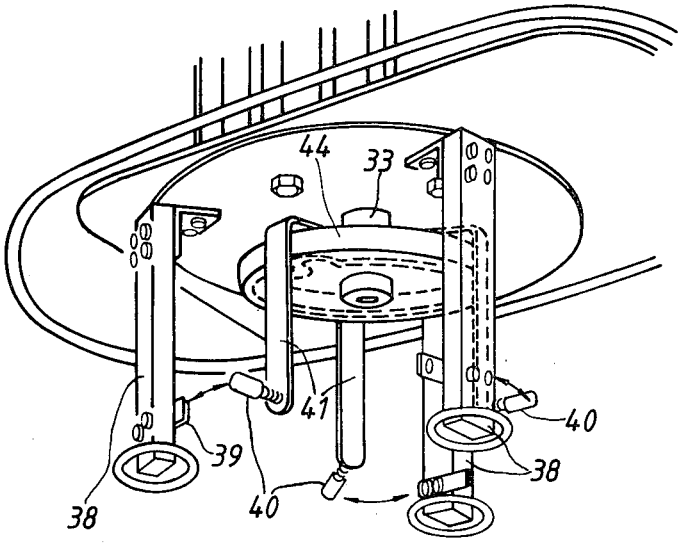
FIG. 5 shows a perspective view of a switch for a damping resistor of the on-load tap changer.
Figure 6:
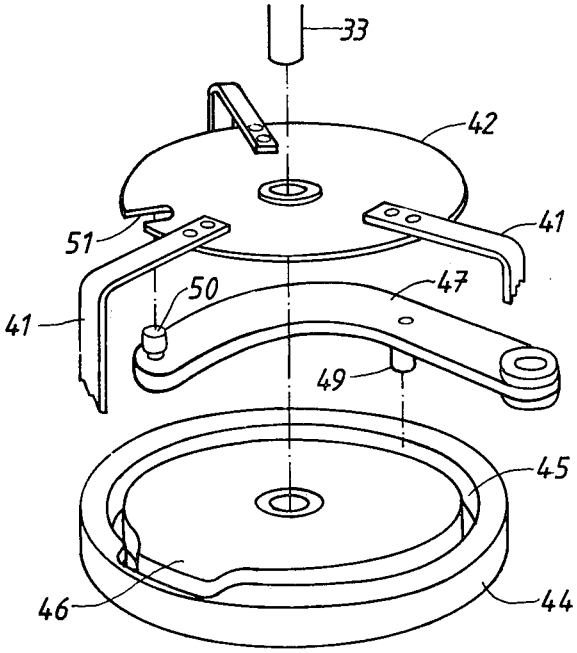
FIG. 6 is an exploded view of the drive means for the damping resistor switch.
Figure 7:
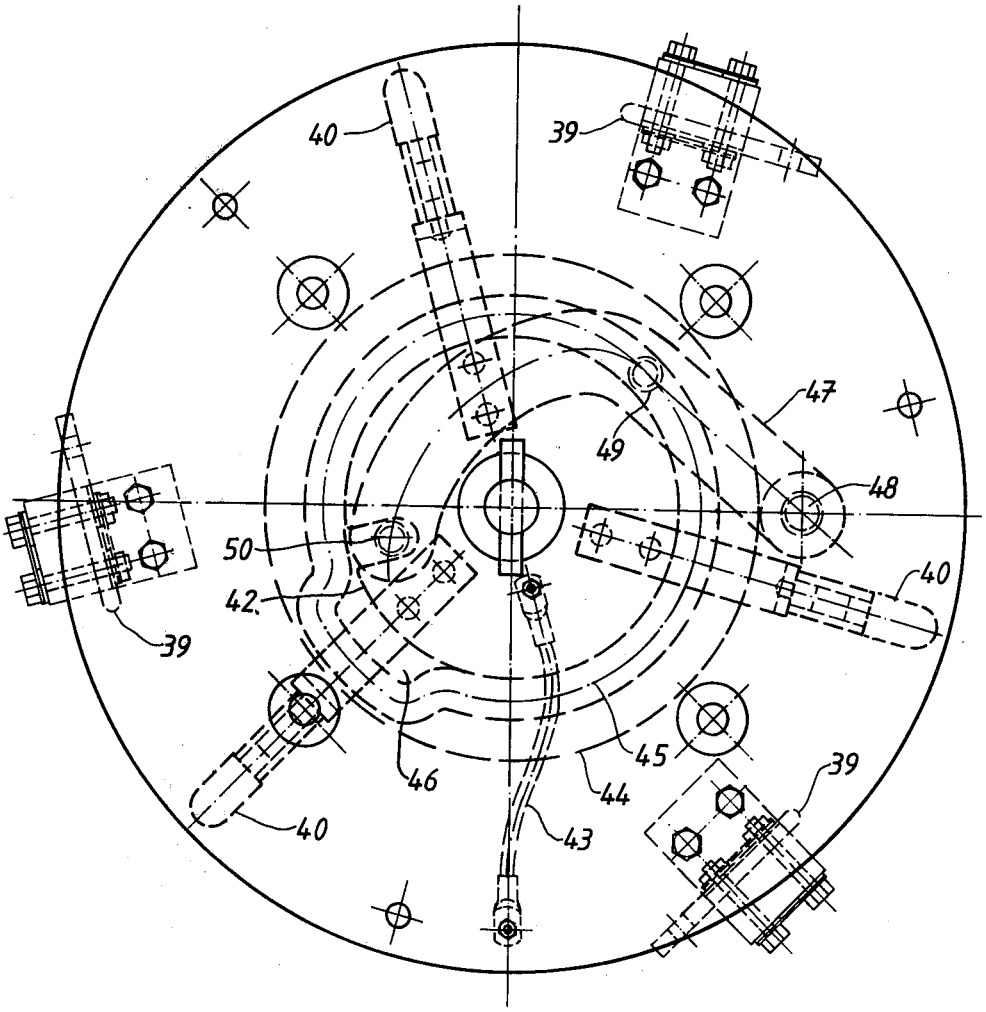
FIG. 7 shows the same switch in a plane view.

FIGS. 5, 6 and 7 show how switch K for damping resistors 26–28 is constructed. It has three fixed contacts 39 which are each mounted on an insulating rod 38 and each of which are intended to be connected to fine step winding 23 in one phase by damping resistors, as is clear from FIG. 1. Movable contacts 40 of the switch are each resiliently attached to one contact arm 41. These arms are supported by metallic disc 42 which is connected, through flexible conductor 43, to a point common to the phases with a defined potential. Disc 42 is rotatably journalled on selector shaft 33 which is connected to selector arms V. The switch is driven directly from shaft 33 through guiding disc 44, fixedly mounted on the shaft, with slot 45 which deviates from the circular shape only in connection with cam 46 but which is otherwise circular. Guiding disc 44 is mechanically coupled to contact holder disc 42 through guiding arm 47 which is rotatably journalled on shaft pin 48 attached to the frame of the switch. Guiding arm 47 is provided with two guiding pins 49 and 50 arranged on opposite sides of the arm, one of the pins 49 projecting into cam slot 45 of the guiding disc and the other pin 50 projecting into radial notch 51 in the periphery of contact holder disc 42. The guiding pins are provided with rollers to reduce friction.

When selector shaft 33 and thus guiding disc 44 are rotated, guiding arm 47, as is best illustrated in FIG. 7, and thus contact holder disc 42 remains stationary in the shown position until cam 46 of guiding disc 44 contacts guiding pin 49 of guiding arm 47. Guiding arm 47 and contact holder disc 42 are then rotated so that movable contacts 40 of the switch are pressed against fixed contacts 39. When cam 46 has passed guiding pin 49, contacts 40 swing back to the position shown in FIG. 7. Contact arms 41 are thus caused to make a forward and backward movement briefly in connection with the operation of the plus/minus switch, as is symbolized by the two-way arrows in FIG. 5.

What is claimed is:

1. On-load tap changer for a transformer having a base winding and a regulating winding, comprising:

a diverter switch having at least two fixed contacts;

a step selector having a plurality of fixed contacts connected to taps on said regulating winding and cooperating with two movable contacts, said movable contacts being mounted on two rotatable drive shafts and connected to the fixed contacts of said diverter switch;

a drive mechanism connected to the drive shafts of said step selector for rotating the shafts in steps relative to each other;

a plus/minus or coarse/fine switch connecting said regulating winding to said base winding; and a damping switch for temporarily during a plus/-minus or a coarse/fine switching operation connecting said regulating winding through a damping resistor to a point of defined potential, said damping switch having cooperating fixed and movable contacts and comprising operating means including a cam member, said cam member being fixedly mounted on one of the drive shafts of said step selector and operatively connected to said movable damping switch contacts.

2. On-load tap changer according to claim 1, wherein said movable contacts of said damping switch are supported by a contact holder rotatably journalled on one of said drive shafts, said contact holder being connected to said cam member through a guiding arm, and said cam member including a disc with a cam slot for engaging said guiding arm.

3. On-load tap changer according to claim 2, wherein said guiding arm is rotatably journalled at a radial distance from said one drive shaft and includes two guiding pins, one of said guiding pins cooperating with said cam member and the other of said guiding pins engaging said contact holder.

* * * * *